US009356346B2

(12) United States Patent
Ownbey et al.

(10) Patent No.: US 9,356,346 B2
(45) **Date of Patent: *May 31, 2016**

(54) SINGLE PORT DUAL ANTENNA

(71) Applicant: AT&T Mobility II LLC, Atlanta, GA (US)

(72) Inventors: Judson Kyle Ownbey, San Diego, CA (US); Scott Clemons, San Diego, CA (US)

(73) Assignee: AT&T Mobility II LLC, Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/568,614

(22) Filed: Dec. 12, 2014

(65) Prior Publication Data

US 2015/0097744 A1 Apr. 9, 2015

Related U.S. Application Data

(60) Division of application No. 13/954,797, filed on Jul. 30, 2013, which is a continuation of application No. 11/951,190, filed on Dec. 5, 2007, now Pat. No. 8,502,743.

(51) Int. Cl.

| | |
|---|---|
| ***H01Q 3/08*** | (2006.01) |
| ***H01Q 25/00*** | (2006.01) |
| ***H01Q 1/24*** | (2006.01) |

(52) U.S. Cl.

CPC ..... *H01Q 3/08* (2013.01); *H01Q 1/246* (2013.01); *H01Q 25/005* (2013.01)

(58) Field of Classification Search

CPC ..... H01Q 1/246; H01Q 3/04; H01Q 3/08; H01Q 5/55; H01Q 13/02; H01Q 21/064; H01Q 25/04; H01Q 25/005

See application file for complete search history.

(56) References Cited

U.S. PATENT DOCUMENTS

| | | | | |
|---|---|---|---|---|
| 2,809,370 | A | 10/1957 | Pinnell | |
| 3,377,593 | A | 4/1968 | Sansom | |
| 6,249,247 | B1 | 6/2001 | Inugai et al. | |
| 6,470,186 | B1 | 10/2002 | Whikehart et al. | |
| 6,486,832 | B1 | 11/2002 | Abramov et al. | |
| 6,956,537 | B2 | 10/2005 | Scherzer et al. | |
| 7,064,726 | B2 | 6/2006 | Kitamori et al. | |
| 7,095,383 | B2 | 8/2006 | Zigler et al. | |
| 7,148,855 | B1 | 12/2006 | Homer et al. | |
| 7,167,136 | B2 | 1/2007 | Thudor et al. | |
| 7,679,575 | B1 | 3/2010 | Horner et al. | |
| 8,502,743 | B2 * | 8/2013 | Ownbey et al. | 343/758 |
| 2007/0030208 | A1 * | 2/2007 | Linehan | 343/757 |
| 2008/0062062 | A1 * | 3/2008 | Borau et al. | 343/844 |

OTHER PUBLICATIONS

U.S. Office Action dated Dec. 27, 2010 in U.S. Appl. No. 11/951,190.

(Continued)

*Primary Examiner* — Robert Karacsony
(74) *Attorney, Agent, or Firm* — Hartman & Citrin LLC

(57) ABSTRACT

A system for transmitting radio frequency includes antenna elements configured to transmit radio frequency beams including a horizontal beam widths and vertical beam widths. The antenna elements are positioned to transmit radio frequency in directions to cover areas independent of each other. The system includes a port operatively coupled to the antenna elements to transmit power to the antenna elements to cause the antenna elements to transmit radio frequency in the respective directions. The antenna elements and the port form a distributed antenna system.

19 Claims, 6 Drawing Sheets

(56) References Cited

OTHER PUBLICATIONS

U.S. Office Action dated Sep. 2, 2011 in U.S. Appl. No. 11/951,190.
U.S. Notice of Allowance dated Apr. 2, 2013 in U.S. Appl. No. 11/951,190.
U.S. Office Action dated Dec. 16, 2013 in U.S. Appl. No. 13/954,797.
U.S. Notice of Allowance dated Feb. 12, 2014 in U.S. Appl. No. 13/954,797.
U.S. Notice of Allowance dated Jun. 24, 2014 in U.S. Appl. No. 13/954,797.

* cited by examiner

SINGLE PORT DUAL ANTENNA

CROSS-REFERENCE TO RELATED APPLICATIONS

This application is a divisional of and claims priority to U.S. patent application Ser. No. 13/954,797, filed Jul. 30, 2013, now U.S. Pat. No. 9,059,501, which is a continuation of U.S. patent application Ser. No. 11/951,190, filed Dec. 5, 2007, now U.S. Pat. No. 8,502,743, the entire contents of each herein incorporated by reference.

TECHNICAL FIELD

This specification relates to radio frequency transmission.

BACKGROUND

A Distributed Antenna System (DAS) includes a network of spatially separated antenna nodes connected to a common source via a transport medium that provides wireless service within a geographic area or structure. DAS can be designed to divide transmitted power among several antenna elements, separated in space. In this manner, a single antenna radiating at high power can be replaced by two or more low-power antennas where the area of coverage provided by the two or more low power antennas is comparable to the area of coverage provided by the single high power antenna.

SUMMARY

This specification describes technologies relating to a single port dual antenna.

In general, in one aspect, the subject matter can be implemented as a system including a first antenna element configured to transmit a first radio frequency beam comprising a first horizontal beam width and a first vertical beam width, the first antenna element positioned to transmit the first radio frequency beam in a first direction to cover a first area; a second antenna element configured to transmit a second radio frequency beam comprising a second horizontal beam width and a second vertical beam width, the second antenna element positioned to transmit the second radio frequency beam in a second direction, relative to the first direction, to cover a second area, the second area spatially independent of the first area; and a port operatively coupled to the first and the second antenna elements, the port configured to transmit power to the first and the second antenna elements to cause the first antenna element and the second antenna element to transmit radio frequency in the first and the second direction, respectively.

The subject matter also can be implemented to include a housing constructed and arranged to retain the first antenna element, the second antenna element, and the port. Further, the subject matter can be implemented to include a mount comprising a first end and a second end, the mount constructed and arranged to retain the first antenna element and the second antenna element at the first end, and the port at the second end. Additionally, the subject matter can be implemented such that the mount is hollow, the system further comprising wires operatively coupled to the first antenna element and the second antenna element at the first end and the port at the second end, the wires to transmit the power supplied to the port from an external source to the first antenna element and the second antenna element to cause the first antenna element and the second antenna element to transmit the first radio frequency beam and the second radio frequency beam, respectively.

In general, in another aspect, the subject matter can be implemented to include configuring a first antenna element of a distributed antenna system to transmit a first radio frequency beam, the first radio frequency beam comprising a first horizontal beam width and a first vertical beam width, the first radio frequency beam covering a first area in accordance with the first horizontal beam width and the first vertical beam width; configuring a second antenna element of the distributed antenna system to transmit a second radio frequency beam, the second radio frequency beam comprising a second horizontal beam width and a second vertical beam width, the second radio frequency beam covering a second area in accordance with the second horizontal beam width and the second vertical beam width; positioning the first antenna element to transmit the first radio beam in a first direction, the first radio frequency beam covering the first area when transmitted in the first direction; positioning the second antenna element, relative to the first antenna element, to transmit the second radio beam in a second direction, the second radio frequency beam covering the second area when transmitted in the second direction, the first area spatially independent of the second area; and transmitting power to the first and the second antenna elements through a port, common to the first and the second antenna elements, to cause the first antenna element to transmit radio frequency in the first direction and the second antenna element to transmit radio frequency in the second direction, wherein the desired directions comprise the first direction and the second direction.

The subject matter also can be implemented such that the first area and the second area form an area of coverage, and wherein the area of coverage is altered by changing the first direction relative to the second direction. Further, the subject matter can be implemented such that the first antenna element, the second antenna element, and the port are positioned in a housing constructed and arranged to retain the first antenna element, the second antenna element, and the port. Additionally, the subject matter can be implemented such that the housing comprises a cylindrical cross-section.

Particular implementations of the subject matter described in this specification can be implemented to realize one or more of the following advantages. Assembling an antenna system that includes two antenna elements can enable transmitting radio frequency (RF) to provide directional coverage for mobile devices, e.g., mobile telephones. The power of the RF, transmitted in a desired direction, can be increased, thereby increasing the dimensions of the area covered. Because the antenna system is designed to provide directional coverage, a number of mobile devices that can receive service from the antenna system in the covered area can also be increased. By reducing RF transmission in directions other than a desired direction, signal loss and power consumption can be decreased. Further, adding vertical tilt to one or more antenna elements in the system can facilitate installing the antenna system at an elevation and providing coverage to regions located below the installation site. Through configuration of the antenna system, power consumption of the system, the area covered, and the number of mobile devices that receive service can be improved.

The details of one or more implementations are set forth in the accompanying drawings and the description below. Other features, aspects, and advantages will become apparent from the description, the drawings, and the claims.

BRIEF DESCRIPTION OF THE DRAWINGS

Like reference numbers and designations in the various drawings indicate like elements.

DETAILED DESCRIPTION

Figure 1:
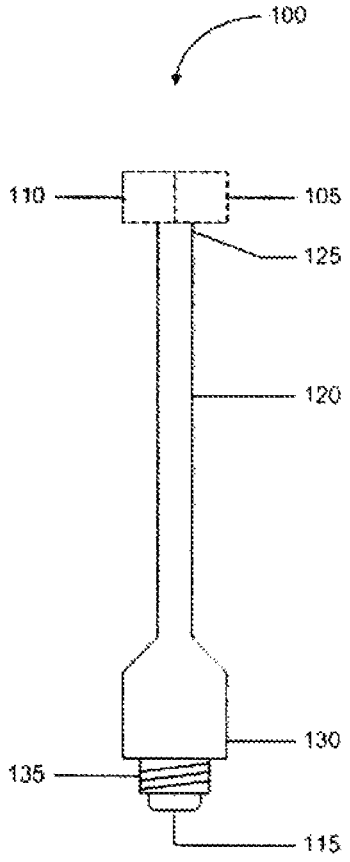
FIG. 1 is schematic of an example of a single port dual antenna system.

FIG. 1 depicts a schematic of an example of a single port dual antenna system 100 configured to transmit RF signals. The single port dual antenna system 100 serves as a base station from which RF signals are transmitted to provide coverage to enable the operation of mobile communication devices, e.g., mobile telephones. The single port dual antenna system (hereinafter "system") 100 includes a first antenna element 105 configured to transmit a first RF beam and a second antenna element 110 configured to transmit a second RF beam. The system 100 includes a port (or "connector") 115 operatively coupled to the first antenna element 105 and the second antenna element 110 to transmit power to the first and second antenna elements 105 and 110. The antenna elements of the system 100 are included in a distributed antenna system (DAS) and are positioned relative to each other such that the RF signals transmitted by one antenna element cover an area that is spatially independent from the area covered by the other antenna element. For example, the area covered by the first RF beam does not overlap the area covered by the second RF beam. In this manner, the system 100 can be configured as a DAS by positioning the antenna elements so as to control the direction of the RF transmitted by the system 100. The system 100 can serve as a base station to enable the operation of mobile communication devices that lie within the areas covered by the first RF beam and the second RF beam.

The antenna elements included in the system 100 can be arranged to face particular directions to transmit RF signals and to provide service to mobile communication devices, e.g., mobile telephones, that lie within a covered area. For example, a geographic area can include a straight stretch of a highway, and coverage can be provided only along the length of the highway and not in directions transverse to the highway. In such implementations, the system 100 can be positioned at a location adjacent to the stretch of highway. Further, the first antenna element 105 can be configured to transmit an RF beam in a first direction along the highway and the second antenna element 110 can be configured to transmit an RF beam in a second direction along the highway, such as a direction that is opposite the first direction by 180 degrees. In this manner, the two antenna elements can provide RF coverage along the stretch of the highway without transmitting RF in directions transverse to the highway. Accordingly, the coverage area can be focused.

In some implementations, the system 100 can include additional antenna elements configured to transmit additional RF beams. The first antenna element 105 can be configured to transmit a first RF beam that has a first horizontal beam width and a first vertical beam width. In some implementations, the first horizontal beam width can be between 33 degrees and 105 degrees. For example, the first horizontal beam width can be 72 degrees. Further, the first vertical beam width can be between 4 degrees and 24 degrees. For example, the first vertical beam width can be 14 degrees.

The second antenna element 105 can be configured to transmit a second RF beam that has a second horizontal beam width and a second vertical beam width. The second horizontal and vertical beam widths can be the same as or different from the first horizontal and vertical beam widths. In some implementations, the second horizontal beam width can be between 33 degrees and 105 degrees. For example, the second horizontal beam width also can be 72 degrees. The second vertical beam width can be between 4 degrees and 24 degrees. For example, the second vertical beam width also can be 14 degrees. In some implementations, the horizontal and vertical beam widths of the first and second antenna elements can be configured so as to enhance the coverage and/or capacity while ensuring that the area of coverage of the RF beam transmitted by one antenna element does not overlap area of coverage of the RF transmitted by the other antenna element. Although the parameters of the antenna elements are chosen such that the areas of coverage of the RF beams transmitted by the antenna elements do not overlap, marginal overlapping may occur due to the design of the system 100, e.g., the positioning of the antenna elements adjacent to one another.

The port 115 is operatively coupled to the first antenna element 105 and the second antenna element 110 through wired means. Power can be transmitted to the first antenna element 105 and the second antenna element 110 through the port 115 to cause the antenna elements 105 and 110 to transmit the RF beams. In some implementations, the system 100 can include a mount 120 configured to retain the first antenna element 105, the second antenna element 110, and the port 115. The first antenna element 105 and the second antenna element 110 can be positioned on a first end 125 of the mount 120, while the port can be positioned on a second end 130 of the mount 120. For example, the antenna elements and the port can be fastened to corresponding ends of the mount 120 using screws. Further, the mount 120 can include a hollow portion through which one or more wires can be positioned within the mount 120. Additionally, one or more wires can connect the antenna elements 105 and 110 to the port 115. For example, the port 115 can be implemented using an N-Type Connector (or "N connector") or a Deutsches Institut fur Normung (or "DIN") connector. Alternatively, the wires connecting the port 115 and the antenna elements 105 and 110 can be wrapped around the outside of the mount 120. In addition, the mount 120 can include a threaded portion 135 to enable screwing the mount 120 into a previously drilled and tapped location. The mount 120 can be made from any material, e.g., metal, plastic, and the like, using suitable manufacturing methods, e.g., injection molding of plastic, and the like. The mount 120 can be of any height (e.g., 24 inches) and have any cross-sectional shape and dimension.

Figure 2:
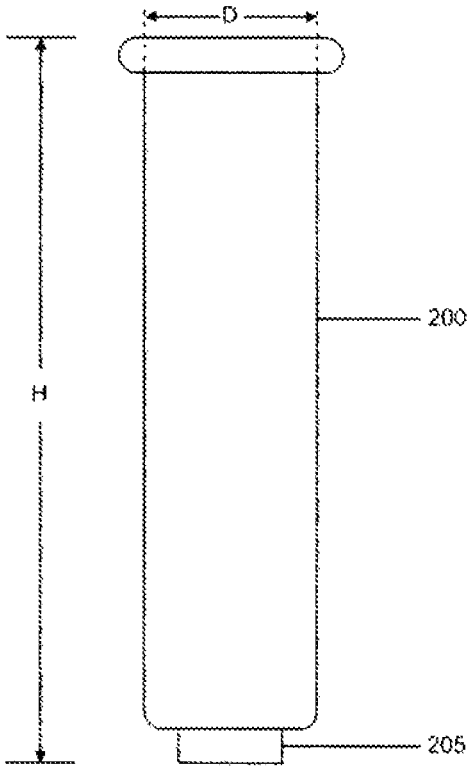
FIG. 2 is a schematic of a housing for the single port dual antenna system.

FIG. 2 depicts a schematic of an example of a housing 200 for the system 100. The housing 200 is constructed and arranged to retain the first antenna element 105, the second antenna element 110, and the port 115. In some implementations, the housing 200 can be constructed and arranged to retain the mount 120 on which the antenna elements and the port 115 are previously mounted. The housing 200 can be hollow such that the mount 120 can be positioned within the housing 200 and retained using mechanisms, e.g., fasteners such as screws. The height, H, the cross-sectional shape, and cross-sectional dimension, D, of the housing can be chosen based on factors including the dimensions of the mount 120, aesthetics of the system, regulations prevailing at sites where the system 100 will be installed, and the like. For example, the height (H) of the housing 200 can be 2 feet, the housing can have a circular cross-section, and the cross-sectional dimension (D) of the housing can be 7 inches. Alternatively, the housing can be of any cross-sectional shape, e.g., triangle, rectangle, regular or irregular polygon, elliptical, and the like, and can be of any suitable height and cross-sectional dimensions. The housing 200 can include a housing ring 205 that can be constructed and arranged to fit directly at the installation sites, e.g., at light poles. In some implementations, the installation sites can be constructed and arranged such that the threaded portion 135 of the mount 120 can be screwed into the installation site, and the housing ring 205 can be positioned around the installation site.

Figure 3A:
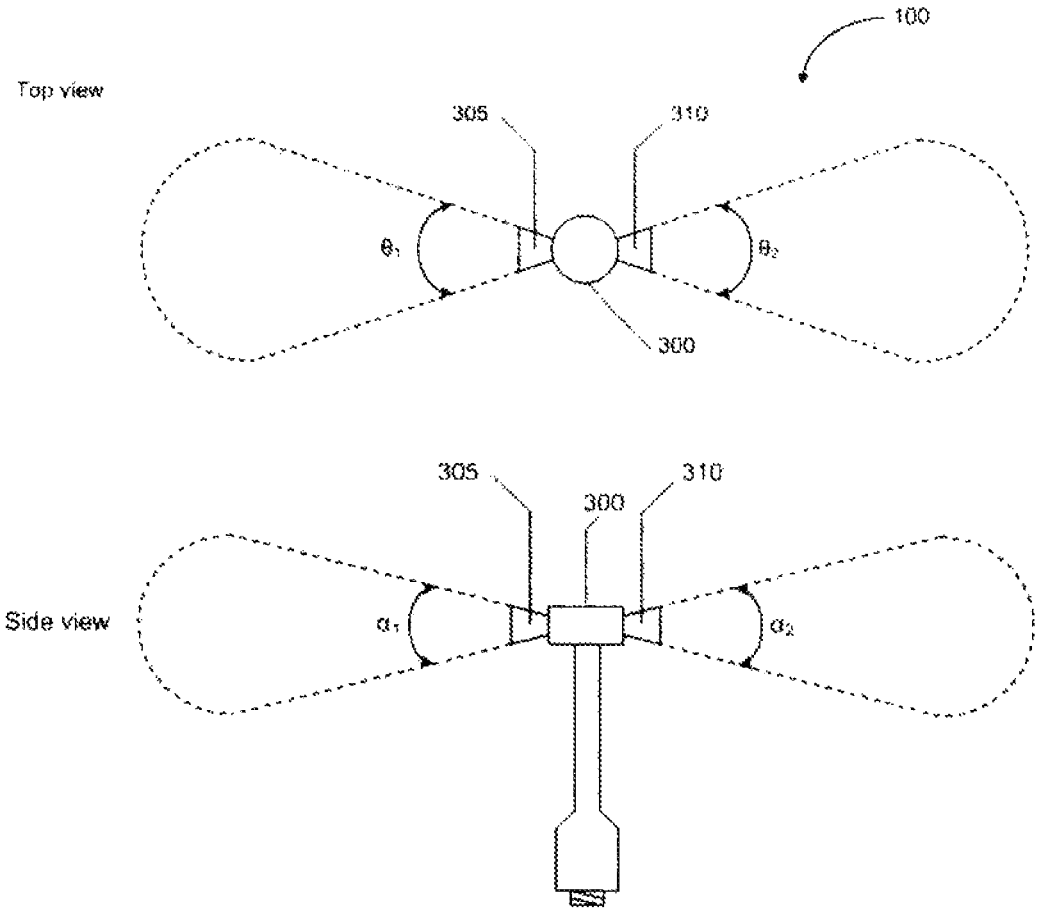
FIG. 3A is an example of a coverage pattern provided by the single port dual antenna system.

FIG. 3A depicts an example of a coverage pattern provided by the single port dual antenna system 100 in the DAS. The system 100 includes a first antenna element 305 and a second antenna element 310 positioned on a mount 300. The first antenna element 305 and the second antenna element 310 are operatively coupled to a common port, also positioned on the mount 300, which transmits power, e.g., voltage, to the two antenna elements. Upon receiving the voltage transmitted through the common port, the first antenna element 305 and the second antenna element 310 transmit a first RF beam and a second RF beam, respectively, in a first direction and a second direction, respectively. The first radio frequency beam, transmitted by the first antenna element 305, has a first horizontal beam width, $\theta_1$, and a first vertical beam width, $\alpha_1$. The second radio frequency beam, transmitted by the second antenna element 310, has a second horizontal beam width, $\theta_2$, and a second vertical beam width, $\alpha_2$. Factors, including the horizontal beam width, the vertical beam width, the elevation of an antenna element, transmission power, and a distance traveled by the radio frequency beam, define an area of coverage. Further, an area of coverage also can be influenced by environmental factors, such as terrain and obstructions. One or more mobile communication devices, such as mobile telephones, within a first area of coverage of the first radio frequency beam are capable of receiving telephone service from the system. Similarly, mobile telephones within a second area of coverage of the second radio frequency beam are also capable of receiving telephone service from the system. Further, the capacity of the system 100, which is a number of mobile devices, e.g., mobile telephones, that can receive coverage, is determined by the power supplied to the first antenna element 305 and the second antenna element 310.

Figure 3B:
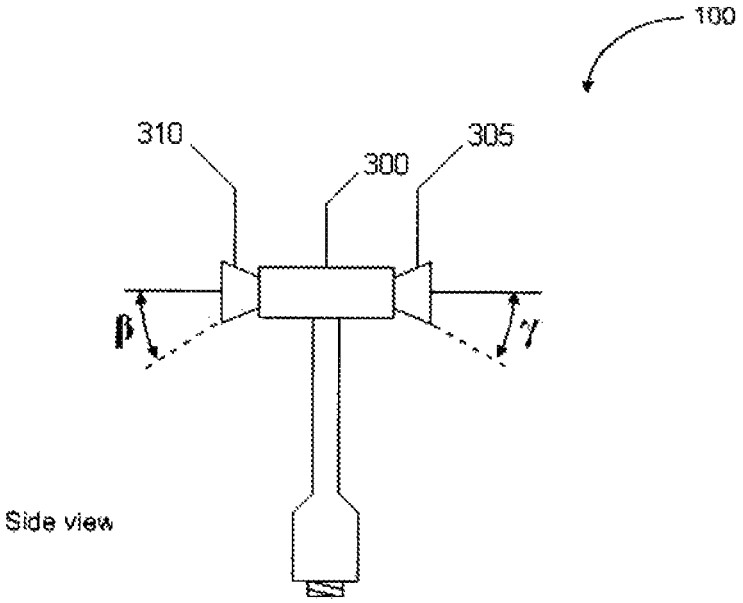
FIG. 3B is an example of a down tilt in the single port dual antenna system.

FIG. 3B is an example of a down-tilt in the single port dual antenna system 100. In some implementations, an antenna element in the system 100 can be down-tilted by a down tilt angle. For example, the system 100 can be installed at an elevation, such as atop or on the slope of a hill above surrounding terrain. The desired area of coverage can be one or more regions below the system 100. In some implementations, an antenna element can have an electrical down-tilt of a predetermined number of degrees. For example, the first antenna element 305 can have an electrical down-tilt of angle $\gamma$, providing a coverage area in a particular portion of terrain below the first antenna element 305. In some implementations, the down-tilt angle can be 0, 4, 6, or 8 degrees. Similarly, the second antenna element 310 can have an electrical down-tilt of angle $\beta$, providing a coverage area in a particular portion of terrain below the second antenna element. The down-tilt angle $\gamma$ of the first antenna element 305 can be the same as or different from the down-tilt angle $\theta$ of the second antenna element 310. In some other implementations, the down-tilt angle of an antenna element can be implemented mechanically, such as by positioning the antenna element on the mount 300 at a down-tilt, or through a combination of mechanical and electrical down-tilting. Changing the down-tilt angle of one antenna element can be performed without affecting the orientation of another antenna element in the system 100. In some implementations, the down-tilt angles can range between 0 and 8 degrees. Alternatively, the down-tilt angles can span larger ranges, particularly in systems 100 where the orientation of the first antenna element 305 on the mount 300 can be changed without affecting the orientation of the second antenna element 310, and vice versa.

The horizontal and vertical beam widths, and the down-tilt angle can be selected based on the installation site. In such instances, antenna elements of specified horizontal and vertical beam widths can be chosen, and positioned on a mount 300 at predetermined positions. Any desired down-tilt angle associated with an antenna element also can be preconfigured. Subsequently, the mount 300 can be positioned within a housing 200 and installed at the installation site. In such implementations, the parameters of the system 100 can be fixed. Alternatively, the first antenna element 305 and the second antenna element 310 can be positioned on the mount 300 such that the positions of the antenna elements on the mount 300 and the relative positions of the two antenna elements are variable. In such implementations, the ability to alter the parameters of the system 100 enables accessing the system 100 at a first installation site, changing one or more parameters of the system 100 to conform to a new configuration, and activating the reconfigured system 100 at the first installation site or at a second installation site. In some implementations, the mount 300 can be configured such that the position of the antenna elements 305 and 310 can be altered from a remote location. For example, the mount 300 can include one or more remotely-operable motors to which the antenna elements 305 and 310 are operatively coupled. The one or more motors can be operated to change the orientations of either or both the antenna elements 305 and 310 to change the directions in which the antenna elements transmit the respective RF beams. Further, the down-tilt angles of one or both antenna elements can also be changed remotely. In some implementations, the port can be configured to change the voltage transmitted to each antenna element depending on the area covered by the respective antenna element.

Figure 3C:
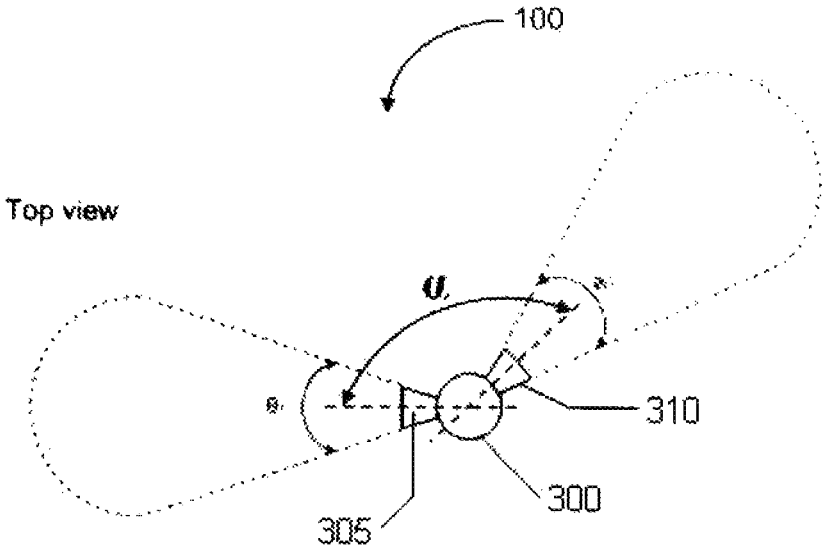
FIG. 3C is an example of an antenna element arrangement for a single port dual antenna.

FIG. 3C is an example of an antenna element arrangement for a single port dual antenna. A first antenna element 305 and a second antenna element 310 can be positioned on the mount 300 such that the angle, $\alpha$, between the orientation of the first antenna element 305 and the second antenna element 310 is between 33 and 180 degrees. For example, the first antenna element 305 can be positioned on the mount 300 relative to the second antenna element 310 such that the angle $\alpha$ is 120 degrees.

Figure 4:
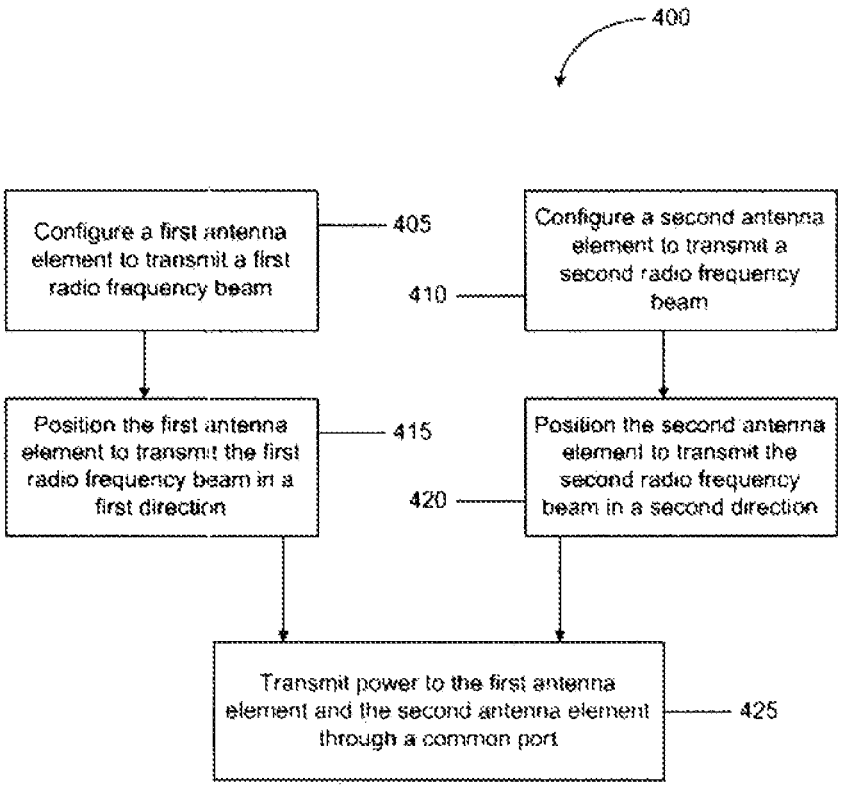
FIG. 4 is an example of a flow diagram for operating a single port dual antenna system.

FIG. 4 is a flow diagram of an example process 400 for operating a single port dual antenna system 100. The process 400 includes configuring a first antenna element to transmit a first radio frequency beam (405). For example, the first antenna element can be made of material capable of transmitting RF signals. Further, the first antenna element can be constructed and arranged such that, in response to receiving power, e.g., voltage, the first antenna element transmits a radio frequency beam having a first horizontal width and a first vertical width.

The process 400 further includes configuring a second antenna element to transmit a second radio frequency beam (410). For example, the second antenna element can also be made of material capable of transmitting RF signals. Further, the second antenna element can be constructed and arranged such that, in response to receiving power, e.g., voltage, the second antenna element transmits a radio frequency beam having a second horizontal width and a second vertical width.

The first and second RF beams transmitted by the first and second antenna elements, respectively, can vary with respect to system parameters and system properties, including one or more dimensions, power, coverage area, and the like. In some implementations, a common signal can be provided to both the first and second antenna elements through a splitter.

The first antenna element can be positioned to transmit the first RF beam in a first direction (415). For example, the first antenna element can be positioned on a first end of a mount to transmit the first radio frequency beam in a desired first direction of coverage. The horizontal width and the vertical width of the beam, and the power transmitted to the antenna element can be determined based on the dimensions of the area of coverage.

The second antenna element can be positioned to transmit the second RF beam in a second direction (420). For example, the second antenna element can be positioned on the first end of the mount, adjacent to the first antenna element, to transmit the second radio frequency beam in a desired second direction of coverage. The horizontal width and the vertical width of the beam, and the power transmitted to the antenna element can be determined based on the dimensions of the area of coverage. In some implementations, the first direction, in which the first antenna element transmits the first radio frequency beam, can be different from second direction, in which the second antenna element transmits the second radio frequency beam, such that the area covered by the first antenna element is spatially independent from that covered by the second antenna element.

Additionally, power can be transmitted to the first antenna element and the second antenna element through a common port (425). For example, the common port can be positioned on the second end of the mount and operatively coupled to the first antenna element and the second antenna element, e.g., using wires, to transmit a voltage to the two antenna elements. The port and the two antenna elements can form a single port dual antenna system for application in a DAS. The antenna system can be installed at an installation site by positioning the mount such that the first antenna element and the second antenna element face in the first direction and the second direction, respectively. Voltage from a power source can be transmitted through the common port to the first and second antenna elements, causing the antenna elements to transmit first and second RF beams, respectively. The RF beams are transmitted in directions corresponding to the orientation of the antenna-elements.

In some implementations, the first and second horizontal beam widths of the first and second radio frequency beams, respectively, can range between 0 degrees and 33 degrees. The first and second vertical beam widths of the first and second radio frequency beams, respectively, can range between 4 degrees and 14 degrees. Other values and ranges of values are also possible for the first and second horizontal and vertical beam widths. The horizontal and vertical beam widths can depend on the construction and arrangement of the antenna element.

Further, the first radio frequency beam and the second frequency beam cover a first area and a second area, respectively. The dimensions of the area of coverage depends on factors including the horizontal and vertical beam widths, the elevation of the antenna elements, the distance traveled by the RF beam, and the power transmitted to the antenna elements. Further, an area of coverage also can be influenced by environmental factors, such as terrain and obstructions.

In some implementations, one of the antenna elements can be down-tilted, e.g., by an angle between 0 degrees and 8 degrees, to change the area of coverage. In such implementations, the position and orientation of one antenna element can be independent of the other antenna element, such that down-tilting one antenna element does not affect the other antenna element. Additionally, an antenna element can be repositioned after the system is installed.

While this specification contains many specifics, these should not be construed as limitations on the scope of the specification or of what may be claimed, but rather as descriptions of features specific to particular implementations. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products.

Thus, particular implementations have been described. Other implementations are within the scope of the following claims. For example, the actions recited in the claims can be performed in a different order and still achieve desirable results. In some implementations, antenna elements can be stacked atop one another to increase capacity of the antenna system. For example, the antenna system can include two antenna element groups, where each antenna element group includes more than one antenna element. The antenna elements of an antenna element group can have the same horizontal and vertical beam widths, can be positioned to face in the same direction, and can be provided the same voltage, thereby increasing the capacity of the DAS in the direction in which the radio frequency beams are transmitted.

In some implementations, a third antenna element can be positioned on the first end of the mount adjacent to the first and second antenna elements. The third antenna element can be configured to transmit a third radio frequency beam including a third horizontal and vertical beam width. The third antenna element can be operatively coupled to the port such that all three antenna elements receive power transmitted through the port. The third antenna element can be positioned to transmit the third frequency beam in a third direction, such that the directions in which the three antenna elements point provide areas of coverage that are spatially independent from each other. In some implementations, the power transmitted to the two antenna elements through the port can be divided equally between the antenna elements. In other implementations, the power can be divided unequally depending on factors including the horizontal and vertical beam widths of each antenna element, the down-tilt angle, and the like.

What is claimed is:

1. A method comprising:

positioning, via a motor, a first antenna element in a first orientation such that the first antenna element transmits a first radio frequency beam in a first direction, the first antenna element operatively coupled to the motor, the first radio frequency beam covering a first area when transmitted in the first direction, and the first area defined at least in part by a first horizontal beam width of the first radio frequency beam, a first vertical beam width of the first radio frequency beam, and a power transmitted to the first antenna element;

positioning, via the motor, a second antenna element in a second orientation, relative to the first orientation of the first antenna element, such that the second antenna element transmits a second radio frequency beam in a second direction, the second antenna element operatively coupled to the motor, and the second radio frequency beam covering a second area when transmitted in the second direction, wherein the second area is defined at least in part by a second horizontal beam width of the second radio frequency beam, a second vertical beam width of the second radio frequency beam, and the power transmitted to the second antenna element, wherein positioning the first antenna element is independent of positioning the second antenna element; and causing transmission of the power to the first antenna element and the second antenna element through a port operatively coupled to the first antenna element and the second antenna element to cause the first antenna element to transmit the first radio frequency beam in the first direction and the second antenna element to transmit the second radio frequency beam in the second direction, wherein the port is common to the first antenna element and the second antenna element.

2. The method of claim 1, wherein the port comprises an N-type connector.

3. The method of claim 1, wherein the first area and the second area form an area of coverage and wherein the area of coverage is altered by changing the first direction relative to the second direction.

4. The method of claim 1, wherein the first area is spatially independent of the second area.

5. The method of claim 1, wherein the first area is at least partially below the first antenna element when the first antenna element is down-tilted by a first down tilt angle.

6. The method of claim 5, wherein the first down tilt angle is alterable, via the motor, from a location remote from the first antenna element.

7. The method of claim 5, wherein the second area is at least partially below the second antenna element when the second antenna element is down-tilted by a second down tilt angle.

8. The method of claim 7, wherein the first down tilt angle and the second down tilt angle are different.

9. The method of claim 7, wherein the second down tilt angle is alterable, via the motor, from a location remote from the second antenna element.

10. The method of claim 7, wherein the first down tilt angle is alterable, via the motor, independent of the second down tilt angle.

11. The method of claim 1, wherein the first antenna element, the second antenna element, and the port are positioned in a housing constructed and arranged to retain the first antenna element, the second antenna element, and the port.

12. The method of claim 11, wherein the housing comprises a cylindrical cross-section.

13. The method of claim 1, wherein the first horizontal beam width is between 33 degrees and 105 degrees.

14. The method of claim 1, wherein the first vertical beam width is between 4 degrees and 24 degrees.

15. The method of claim 1, wherein the second horizontal beam width is between 33 degrees and 105 degrees.

16. The method of claim 1, wherein the second vertical beam width is between 4 degrees and 24 degrees.

17. The method of claim 1, wherein the first antenna element and the second antenna element are positioned at a first end of a mount and the port is positioned at a second end of the mount, and wherein one or more wires operatively coupling the first antenna element to the port and the second antenna element to the port are wrapped around the outside of the mount.

18. The method of claim 17, wherein the first orientation of the first antenna element relative to the second orientation of the second antenna element at the first end of the mount is variable.

19. The method of claim 17, wherein the first antenna element and the second antenna element are positioned on the first end of the mount with an angle of between 33 degrees and 180 degrees between the first antenna element and the second antenna element.

* * * * *